United States Patent [19]

Dieckmann

[11] Patent Number: 4,887,193

[45] Date of Patent: Dec. 12, 1989

[54] MOUNTING APPARATUS FOR A LAMP OR SIMILAR DEVICE

[76] Inventor: Ralf E. Dieckmann, P.O. Box 65, Wilmot, N.H. 03287

[21] Appl. No.: 133,079

[22] Filed: Dec. 15, 1987

[51] Int. Cl.[4] ..... F21V 33/00

[52] U.S. Cl. ..... 362/89; 362/90; 248/230; 83/520; 408/16

[58] Field of Search ..... 248/230, 231; 362/89, 362/90, 91, 382, 804; 81/180.1, 54; 83/520; 408/16; 409/134; 29/57

[56] References Cited

U.S. PATENT DOCUMENTS

| | | | |
|---|---|---|---|
| 1,083,020 | 12/1913 | Love et al. | 362/90 |
| 1,258,707 | 3/1918 | Rice | 248/230 X |
| 1,263,560 | 4/1918 | Kaufmann | 248/230 X |
| 1,284,010 | 11/1918 | Wilbur | 248/230 X |
| 1,858,654 | 5/1932 | See | 362/90 X |
| 2,217,863 | 10/1940 | Gerber, Jr. | 362/90 |
| 2,689,102 | 9/1954 | Whalen | 248/230 |
| 4,702,448 | 10/1987 | LoJacono et al. | 248/230 X |

FOREIGN PATENT DOCUMENTS

| | | | |
|---|---|---|---|
| 76395 | 5/1918 | Fed. Rep. of Germany | 362/84 |
| 653111 | 5/1951 | United Kingdom | 362/89 |

*Primary Examiner*—Ira S. Lazarus
*Assistant Examiner*—Peggy Neil
*Attorney, Agent, or Firm*—Richard C. Litman

[57] ABSTRACT

An accessory device, such as a lamp, includes a mounting mechanism adapted for attachment to various machines. A mount ring is supported by the machine, preferably concentrically to the machine head, through a plurality of attachment assemblies maintaining the ring in a fixed plane but allowing angular displacement thereof to permit selective adjustment of an elongated, flexible accessory-equipped arm.

9 Claims, 3 Drawing Sheets

MOUNTING APPARATUS FOR A LAMP OR SIMILAR DEVICE

BACKGROUND OF THE INVENTION

Machinery, such as metal working machines and the like which involve the attendance of an operator during use, require the provision of adequate lighting for several reasons, not the least of which is safety. Additionally, sufficient illumination is necessary to permit proper setup and subsequent adjustment of the tool and controlling mechanisms of the associated machine. And of course, proper lighting in the area of the tool and workpiece is required to ensure accurate fabrication of the workpiece is required to ensure accurate fabrication of the workpiece. Without specific lighting means for an individual machine, an operator can only perform under the illumination as provided by the available light or overhead lamps, a very undesirable situation in view of the relative low level of illumination and formation of unavoidable shadows.

Presently, such lighting is provided by means of lamps attached at various points to the machinery. This attachment often comprises a bracket or clamping device and even if flexible means such as a gooseneck or pivotal arms are utilized, the degree of effective illumination is substantially restricted since, either the angle or amount of lighting is less than optimal.

Many existing lighting devices for machinery require that the operator cease the machining process in order to readjust the lamp. Such manipulation involves a sacrifice in safety since the operator's attention is shifted from a spinning tool to a distant point whereby an adjustment must be made in order to reposition the lighting apparatus. This adjustment can require several seconds of time and the use of both hands in order to release a lock joint, relocate the lamp and its support and then to retighten the assembly.

Most machines to which the present invention is applicable will be understood to include a turret or head containing a spindle and which either supports a moving tool or workpiece. Examples of such devices include milling machines, laser cutting machines, sewing machines, water jet cutting machines, drill presses, etc.

The apparatus of the present invention serves to allow mounting of an accessory device such as a lamp, to a machine, such as about its head, in a manner permitting ready re-location of the accessory head in an arcuate path about the machine. With this arrangement, the lamp head is initially positioned in the most advantageous location prior to the start of the fabrication process. As the tool progresses in its operation upon the workpiece, the operator often has to shift his position for proper observation of the workpiece. After this shift, the lamp head is often either in the line of sight of the operator, casts an undesirable shadow upon the workpiece or no longer ideally illuminates the workpiece. With the instant apparatus the operator may readily shift the supporting structure for the lamp head in an arcuate path completely about the circumference of the machine head, free of interference with the spinning tool or workpiece, so that the lamp may be directed in a precise manner according to the operator's desires.

In order for the lamp to be rotatable about the work spindle and in a manner not interfering with the tool or workpiece, it is preferably attached to the machine in the area of the head. Possible attachment locations include: the tool end of the spindle, the opposite head end of the spindle, on the ceiling above the head or between the two ends of the spindle. The latter position is proposed by the present invention and includes a circular mount affixed about a machine head and which supports a flexible extension arm attached to the cushion mount and having a lamp head at its distal portion.

Alternatively, the present apparatus may serve to provide adjustable support for other devices rather than lamps. For example, magnifying lenses, measuring devices, video cameras or other structures requiring precise positioning adjacent an operating tool element and which must permit frequent adjustment, all may benefit from the improved assembly of the present invention.

DESCRIPTION OF THE PRIOR ART

Numerous prior known devices have been proposed for providing attachment of lamps to different types of machines. The following U.S. patents are exemplary of the prior art:

| U.S. Patent No. | Inventor |
|---|---|
| 2,795,997 | Allen |
| 3,728,027 | Watanabe |
| 4,084,216 | Shonting |

The above U.S. Pat. No. 2,795,997 to Allen discloses a portable viewing device of a type adapted to illuminate and facilitate the viewing of an object which may otherwise be difficult to see.

U.S. Pat. No. 3,728,027 to Watanabe teaches the concept of a portable apparatus for centering a boring machine by indicating a position perforated by means of projected light allowing the drill to be aligned with the projected light.

U.S. Pat. No. 4,084,216 to Shonting relates to a magnifying device for a sewing machine and which includes a clamp engageable with the head of a sewing machine.

SUMMARY OF THE INVENTION

An object of the present invention is to provide an improved mounting assembly for a lamp or other device including an arcuate support member permitting unimpeded circumferential adjustment and positioning of the lamp or other device relative a tool or workpiece.

Another object of this invention is to provide an improved lamp mounting assembly for a machine tool including a circular support member affixed about the machine head and to which is connected a flexible extension arm provided with a light source.

BRIEF DESCRIPTION OF THE DRAWINGS

Similar reference characters designate corresponding parts throughout the several views of the drawings.

DESCRIPTION OF THE PREFERRED EMBODIMENT

Figure 7:
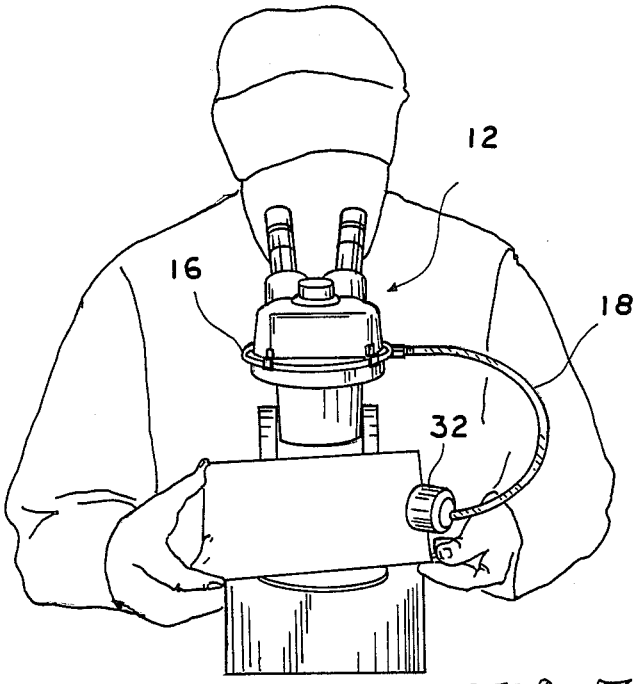
FIG. 7 is an elevational view showing the concept of the present invention as applied to a microscope.

Referring now to the drawings, the mounting apparatus of the present invention will be understood to be usable with any of various devices such as the illustrated vertical milling machine 10. The concept advanced by the instant invention may be employed with numerous alternate devices requiring adequate illumination to insure precise manipulation of a machine and/or the subject workpiece such as the microscopic apparatus 12 of FIG. 7.

Figure 1:
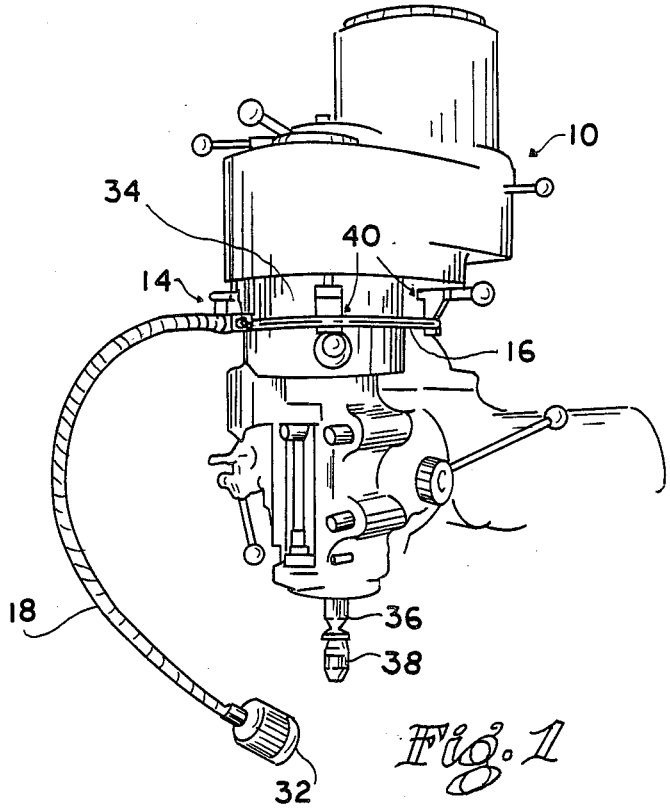
FIG. 1 is a perspective view illustrating the mounting assembly of the present invention as installed upon a vertical milling machine.
Figure 2:
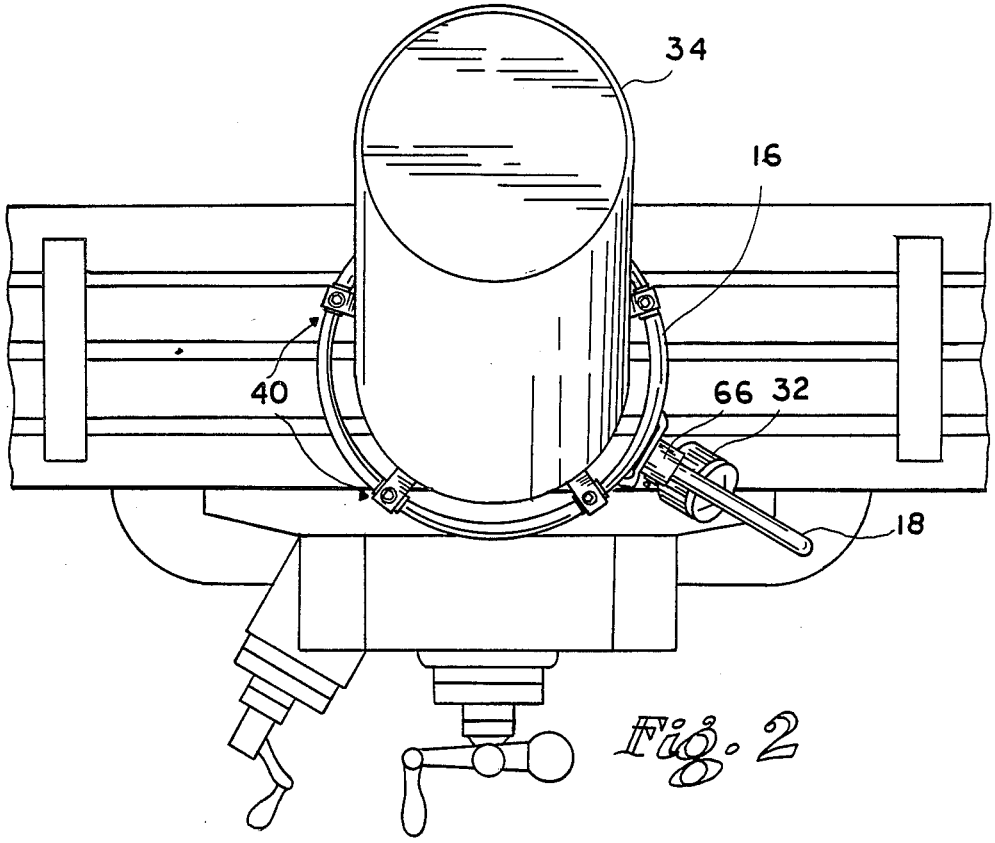
FIG. 2 is a top plan view showing the invention in use.

The lamp mounting assembly of this invention is generally designated 14 and is shown most clearly in FIG. 1 as it may be typically attached to the machine 10. The mounting assembly 14 includes two primary components comprising a mount ring 16 from which is suspended an extension arm 18. The mount ring 16 will be understood to comprise a tubular or rod member formed to define a circular configuration suitably joined in a manner to maintain this circularity.

Figure 4:
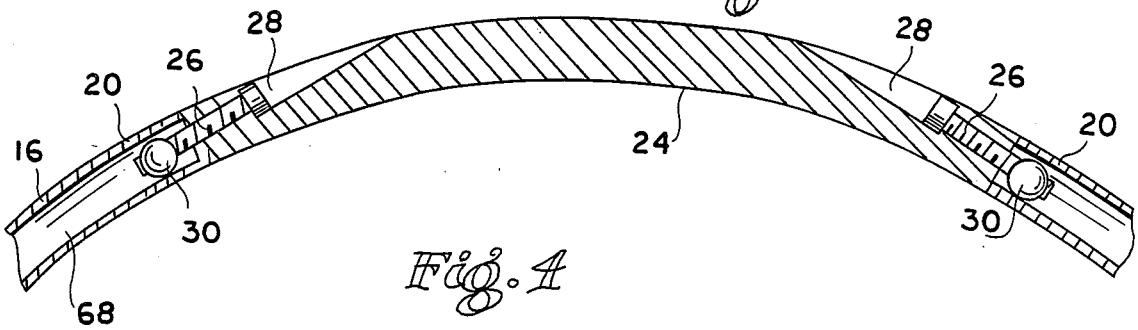
FIG. 4 is a partial, horizontal sectional view of the mount support ring.
Figure 5:
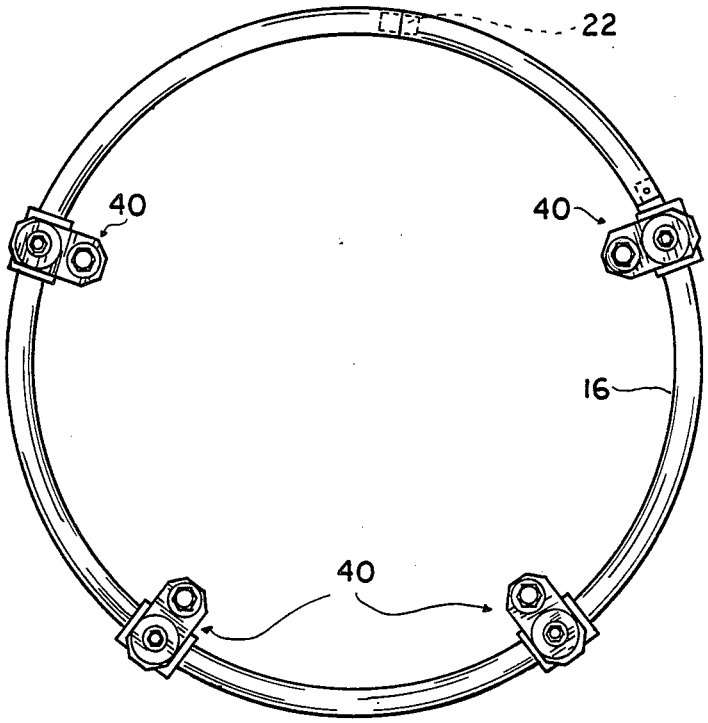
FIG. 5 is a top plan of the mount support ring and the plurality of attachment sub-assemblies.

Alternate means may be utilized to removably join the two free ends 20,20 of the ring 16. A butt joint is shown in FIG. 5 of the drawings wherein the ends 20,20 may be retained by use of a plug 22 or other member providing a press fit with the interior walls of the ring stock. In the embodiment of FIG. 4, the spaced apart ends 20,20 of the ring 16 are joined by a separate rod segment 24 defining an arc having the same radius as the assembled ring 16. In this latter arrangement, the rod is preferably of solid stock and may be affixed by means of screws 26 or other fasteners insertable through countersunk passages 28 in the segment 24 and engageable within cylindrical nuts 30 captively retained within the ends 20 of the ring mount 16.

By providing suitable means allowing assembly and disassembly of the ring mount 16, such as described above, this mount may be readily attached to various machine devices to provide a stable mount fully encircling the machine 360 degrees and presenting a ring having a circular configuration, whether viewed in horizontal plan, or in a vertical cross-section therethrough. In this latter respect, it will be seen that even in the area of the attachment of the free ends 20,20 of the main ring segment 16, no structure of the ring mount projects beyond the circular bounds of the ring mount cross-section. The advantages of this construction will become apparent hereinafter.

In use of the present apparatus, the ring mount 16 is attached to the machine 10 so as to allow disposition of a lamp head 32 on the free end of the extension arm 18, throughout an area most conducive to providing maximum flexibility in directing light from the lamp head 32 upon the tool and workpiece involved.

Figure 3:
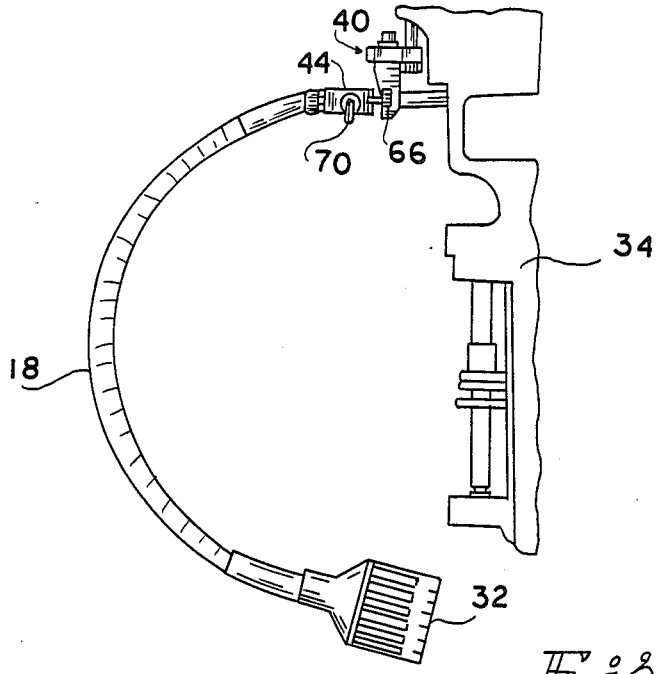
FIG. 3 is an enlarged, partial side elevation of the lamp mounting assembly.
Figure 6:
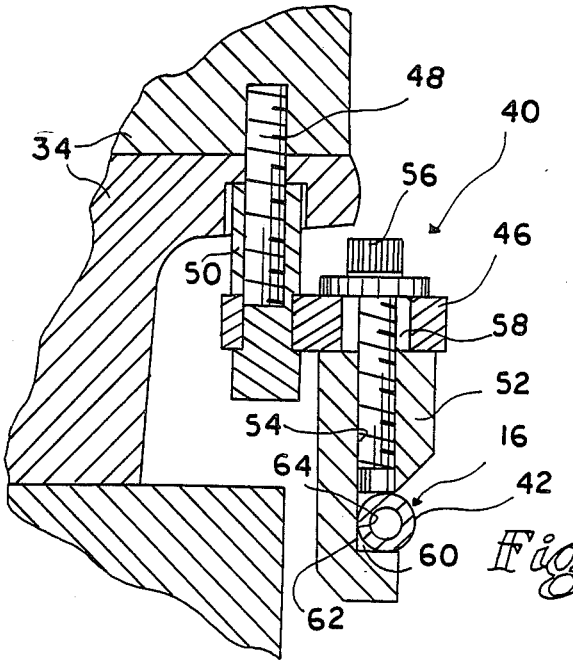
FIG. 6 is an enlarged, vertical sectional view illustrating one of the attachment sub-assemblies for the circular mount support ring.

As previously mentioned, an ideal location for the present assembly, when applied to many machines, is to affix the supporting mount ring 16 about a machine head, intermediate the two ends of the contained spindle of the machine. In the case of the vertical milling machine 10 as illustrated in FIGS. 1,3 and 6, the ring mount is affixed about the machine head 34 which will be understood to contain the spindle 36 as is well known in the art. The lower end of this spindle 36 is shown provided with a tool chuck 38 or other appropriate device.

The circular mount ring 16 is preferably concentrically affixed relative the spindle and head of the involved machine 10 but alternatively, may be mounted eccentrically thereabout. In any case, a plurality of suitable attachment assemblies 40 are provided to affix the mount ring 16 in the manner shown most clearly in FIGS. 1,2,3 and 6 wherein it will be seen that the outermost periphery 42 of the entire mount ring 16 is fully exposed throughout the circumference of the ring 16. This construction allows the fixed attachment of an extension arm mount member 44 to this outermost periphery 42 in a manner fully clear of the plurality of arcuately spaced attachment assemblies 40 for reasons which will be explained hereinbelow.

Each attachment assembly 40 includes a horizontal bracket 46 suitably connected to the machine head 34 such as by the head screws 48. With many machines 10, existing screws may be utilized for this connection, or longer screws 48 may be used with existing tapped bores in the head, together with appropriate spacers 50 as shown most clearly in the detail view of FIG. 6. In any case it will be understood that suitable means are provided to allow attachment of the brackets 46 in a plane or position providing adequate clearance for manipulation of the associated structure of the attachment assemblies 40, pursuant to the configuration of the associated machine. The outer portion of each bracket 46 serves to fixedly support a depending guide 52 provided with a vertical, tapped bore 54. This bore receives a screw 56 disposed through an enlarged bore 58 in the bracket 46. The lower portion of each guide 52 is formed with an outwardly facing seat or channel 60, the height of which provides a close, sliding fit with the periphery of the mount ring 16.

With the above construction it will be seen that the mount ring 16 may be readily affixed about a machine head and maintained in a fixed horizontal plane by its axially captive engagement within the plurality of arcuately spaced attachment assemblies 40. This mounting of the ring is easily achieved by initially moving the guides 52 radially inwardly, toward the machine head 34 and then, after placing the mount ring 16 within the guide channels 60, moving the respective guides outwardly and tightening the screws 56. In this respect, the ring mount and attachment assemblies will appear as in FIG. 6, whereby a close, sliding fit is presented between the innermost periphery 62 of the mount ring 16 and base 64 of the channels 60. The above radial displacement of the guides 52 is possible due to the clearance provided by the over-size bores 58 in the brackets 46.

The mount member 44 of the extension arm 18 is fixed to the outermost periphery 42 of the mount ring 16 by means of a tongue 66, the vertical thickness of which is substantially less than the diameter of the ring 16. In this manner, the mount member 44 is retained in a position radially spaced outwardly of the ring to insure clearance thereof relative the plurality of attachment assemblies 40. The tongue 66 is large enough to provide rigid support of the entire extension arm 18 and to allow the passage of appropriate wiring (not shown) therethrough to support illumination of a bulb carried by the lamp head 32. In this respect, it will be understood that such wiring passes through the interior 68 of the mount ring 16 and passes to the exterior at any suitable point, such as adjacent one of the ring ends 20.

The mount member 44 includes an on/off switch 70 controlling the bulb in the lamp head 32 while the elongated body of the extension arm 18 connecting the mount member 44 and lamp head 32 is preferably of gooseneck construction, allowing substantially universal adjustment of the lamp head 32, of course within the limits of the length of the arm body and the location of the mount member 44.

In use of the assembly of the present invention, an operator may rotate the mount ring 16 within the fixed plane defined by the channels 60 of the plurality of stationary guides 52 in order to most advantageously locate the mount member 44 so as to allow the lamp head 32 to be subsequently positioned in the proper location, as aided by means of the flexibility of the body of the extension arm 18.

From the foregoing it will be seen that an improved lamp mounting apparatus is provided whereby a ring supporting mechanism is easily affixed relative any of various devices and permits full 360 degree arcuate positioning of a flexible, lamp-equipped arm such that maximum illumination of a tool and workpiece is possible without requiring significant effort or causing undesirable distraction on the part of the operator. The mount apparatus may alternatively serve to support devices other than lamp heads and is adaptable to numerous types of tools or machines.

What is claimed is:

1. An accessory mounting apparatus for a machine including;

a substantially continuous mount ring having an outermost periphery, means attaching said mount ring to the machine in a fixed substantially horizontal plane, said mount ring attaching means including a plurality of circumferentially disposed and arcuately spaced apart attachment assemblies each including a bracket fixed relative to the machine, a guide rotatably connected to each said bracket, said guides provided with a radially and outwardly facing channel therewithin, said mount ring disposed within said radially and outwardly facing channels and restrained from vertical displacement therewithin but, with sufficient clearance to enable sliding rotation of said mount ring in said horizontal plane within said channels and concentrically about said machine, said mount ring having an outermost periphery clear of said guides, an extension arm having an accessory head at one end and an arm mount member at the other end, and said extension arm mount member rigidly connected to said mount ring outermost periphery, whereby said extension arm is arcuately movable with said extension arm about the machine.

2. An accessory mounting apparatus according to claim 1 wherein, said extension arm comprises an elongated flexible member whereby, said accessory head is manually displaceable to selectively reposition said accessory head independently of said extension arm mount member.

3. An accessory mounting apparatus according to claim 1 including, a head on the machine having a spindle therethrough, and said mount ring defining a circular configuration substantially concentrically disposed about the spindle.

4. An accessory mounting apparatus according to claim 1 wherein, said mount ring comprises an elongated body having a pair of ends, and connecting means joining said ends whereby, said mount ring presents a rigid circular member allowing for assembly and disassembly about a machine.

5. An accessory mounting apparatus according to claim 4 wherein, said connecting means includes a plug inserted within said elongated body ends.

6. An accessory mounting apparatus according to claim 4 wherein, said connecting means includes a ring segment having opposite ends abutting said tubular body ends, and fastener means removably joining said elongated body and ring segment.

7. An accessory mounting apparatus according to claim 1 wherein, said accessory head includes a lamp.

8. An accessory mounting apparatus according to claim 3 wherein, at least a portion of said mount ring is hollow.

9. An accessory mounting apparatus according to claim 8 wherein, said extension arm has an inner passageway that opens at said other end, an opening on said mount ring outermost periphery proximally to where said extension arm mount member is rigidly connected, an electrical power cable disposed within said mount ring hollow portion and said extension arm inner passageway, and said electrical power cable passing through said outermost periphery opening.

* * * * *